US012385690B2

(12) United States Patent
Allard et al.

(10) Patent No.: US 12,385,690 B2
(45) Date of Patent: Aug. 12, 2025

(54) FEATURE FOR ACCELERATING EVACUATION OF A VACUUM INSULATED STRUCTURE

(71) Applicant: WHIRLPOOL CORPORATION, Benton Harbor, MI (US)

(72) Inventors: Paul Bennett Allard, Coloma, MI (US); Sunil Shivaji Ekshinge, Pune (IN); Chad Eric McCray, Stevensville, MI (US); Jose Guizoni, Jr., Ypsilanti, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 34 days.

(21) Appl. No.: 18/140,140

(22) Filed: Apr. 27, 2023

(65) Prior Publication Data

US 2024/0361068 A1 Oct. 31, 2024

(51) Int. Cl.
*F25D 23/06* (2006.01)

(52) U.S. Cl.
CPC ..... *F25D 23/063* (2013.01); *F25D 23/066* (2013.01); *F25D 2201/14* (2013.01)

(58) Field of Classification Search
CPC ... F25D 23/063; F25D 23/066; F25D 2201/14
USPC ..... 312/400, 405
See application file for complete search history.

(56) References Cited

U.S. PATENT DOCUMENTS 4,082,825 A * 4/1978 Puterbaugh ..... F25D 23/064 264/46.7
4,853,270 A * 8/1989 Wycech ..... B29C 70/66 428/407
4,942,013 A * 7/1990 Palmer ..... B29C 43/3642 264/511
5,509,248 A * 4/1996 Dellby ..... F25D 23/062 220/592.27
5,827,385 A * 10/1998 Meyer ..... B29C 66/61 156/146
6,109,712 A * 8/2000 Haworth ..... A47L 15/4209 312/406

(Continued)

FOREIGN PATENT DOCUMENTS

CN 111457659 A 7/2020
DE 102012221010 A1 5/2014

(Continued)

*Primary Examiner* — Daniel J Troy
*Assistant Examiner* — Timothy M Ayres
(74) *Attorney, Agent, or Firm* — Price Heneveld LLP

(57) ABSTRACT

A vacuum insulated appliance includes a cabinet with an outer wrapper and an inner liner coupled to the outer wrapper. A vacuum insulated cavity is defined between the outer wrapper and the inner liner. A trim breaker is coupled to the outer wrapper and the inner liner and seals the vacuum insulated cavity. An evacuation port is defined by the outer wrapper. An insulation powder is disposed in the vacuum insulated cavity. An open-cell foam is coupled to at least one of an inner surface of the outer wrapper and an inner surface of the inner liner. The open-cell foam defines a first plurality of pores that define a first plurality of airflow paths in fluid communication with the vacuum insulated cavity and the evacuation port for evacuating air from the vacuum insulated cavity, through the first plurality of airflow paths, and through the evacuation port.

13 Claims, 10 Drawing Sheets

(56) References Cited

U.S. PATENT DOCUMENTS

| | | | | |
|---|---|---|---|---|
| 6,171,375 | B1 * | 1/2001 | Howie | B01D 46/50 96/57 |
| 6,668,457 | B1 * | 12/2003 | Czaplicki | B62D 29/002 29/402.09 |
| 6,796,215 | B1 * | 9/2004 | Hauser | F04B 37/14 92/48 |
| 6,883,858 | B2 * | 4/2005 | Barz | B62D 29/002 296/193.06 |
| 9,303,915 | B2 | 4/2016 | Kim et al. | |
| 10,253,919 | B2 | 4/2019 | Kawarazaki et al. | |
| 10,371,430 | B2 | 8/2019 | Kim et al. | |
| 10,422,573 | B2 | 9/2019 | Deka et al. | |
| 10,533,697 | B2 | 1/2020 | Song et al. | |
| 10,605,520 | B1 * | 3/2020 | Ekshinge | F25D 23/067 |
| 10,697,696 | B1 * | 6/2020 | Ekshinge | F16L 59/065 |
| 10,746,343 | B2 * | 8/2020 | Allard | F25D 23/066 |
| 10,781,963 | B2 | 9/2020 | Uekado et al. | |
| 11,029,080 | B2 * | 6/2021 | Naik | F25D 23/062 |
| 11,035,607 | B2 * | 6/2021 | Naik | F25D 23/06 |
| 11,085,690 | B2 | 8/2021 | Naik et al. | |
| 11,300,238 | B2 * | 4/2022 | Allard | F16L 59/065 |
| 11,767,945 | B2 * | 9/2023 | Allard | B32B 7/12 428/34.2 |
| 2011/0239399 | A1 * | 10/2011 | Duncan | A47L 9/00 55/378 |
| 2021/0354421 | A1 * | 11/2021 | Raskar | B32B 5/02 |
| 2022/0055262 | A1 * | 2/2022 | Bauman | B29C 43/32 |
| 2022/0307759 | A1 | 9/2022 | Kim et al. | |

FOREIGN PATENT DOCUMENTS

| | | | |
|---|---|---|---|
| EP | 1335171 | A1 | 8/2003 |
| EP | 3284995 | A1 | 2/2018 |

* cited by examiner

FEATURE FOR ACCELERATING EVACUATION OF A VACUUM INSULATED STRUCTURE

BACKGROUND OF THE DISCLOSURE

The present disclosure generally relates to a vacuum insulated appliance, and more specifically, to a feature for accelerating evacuation from a vacuum insulated appliance.

SUMMARY OF THE DISCLOSURE

According to one aspect of the present disclosure, a vacuum insulated appliance includes a cabinet with an outer wrapper and an inner liner coupled to the outer wrapper. A cabinet vacuum insulated cavity is defined between the outer wrapper and the inner liner. A trim breaker is coupled to the outer wrapper and the inner liner, and the trim breaker seals the cabinet vacuum insulated cavity. A wrapper evacuation port is defined by the outer wrapper. The wrapper evacuation port is in fluid communication with the cabinet vacuum insulated cavity for evacuating air from the cabinet vacuum insulated cavity. A first porous foam is coupled to an inner surface of the outer wrapper. The first porous foam defines a first plurality of pores. The first plurality of pores defines a first airflow path that is in fluid communication with the wrapper evacuation port. A door assembly is coupled to a front portion of the cabinet. The door assembly includes a door wrapper. A door liner is coupled to the door wrapper. A door vacuum insulated cavity is defined between the door wrapper and the door liner. A door evacuation port is defined by the door liner. The door evacuation port is in fluid communication with the door vacuum insulated cavity for evacuating air from the door vacuum insulated cavity. A second porous foam is coupled to an inner surface of the door liner. The second porous foam defines a second plurality of pores. The second plurality of pores defines a second airflow path in fluid communication with the door evacuation port.

According to another aspect of the present disclosure, a vacuum insulated appliance includes a cabinet with an outer wrapper and an inner liner coupled to the outer wrapper. A cabinet vacuum insulated cavity is defined between the outer wrapper and the inner liner. A trim breaker is coupled to the outer wrapper and the inner liner, and the trim breaker seals the cabinet vacuum insulated cavity. A wrapper evacuation port is defined by the outer wrapper. The wrapper evacuation port is in fluid communication with the cabinet vacuum insulated cavity for evacuating air from the cabinet vacuum insulated cavity. A porous foam is coupled to and extends along an inner surface of the outer wrapper. The porous foam defines a plurality of pores. The plurality of pores defines at least one first airflow path in fluid communication with the wrapper evacuation port for evacuating air from the cabinet vacuum insulated cavity through the at least one first airflow path.

According to yet another aspect of the present disclosure, a vacuum insulated door assembly for an appliance includes a door wrapper. A door liner is coupled to the door wrapper. The door liner defines a door evacuation port. A door vacuum insulated cavity is defined between the door wrapper and the door liner. Insulation powder is disposed within the door vacuum insulated cavity. A porous foam is coupled to an inner surface of the door liner. The porous foam defines a plurality of pores. The plurality of pores defines a plurality of airflow paths in fluid communication with the door vacuum insulated cavity and the door evacuation port for evacuating air from the door vacuum insulated cavity, through the plurality of airflow paths, and the door evacuation port.

These and other features, advantages, and objects of the present disclosure will be further understood and appreciated by those skilled in the art by reference to the following specification, claims, and appended drawings.

Figure 1:
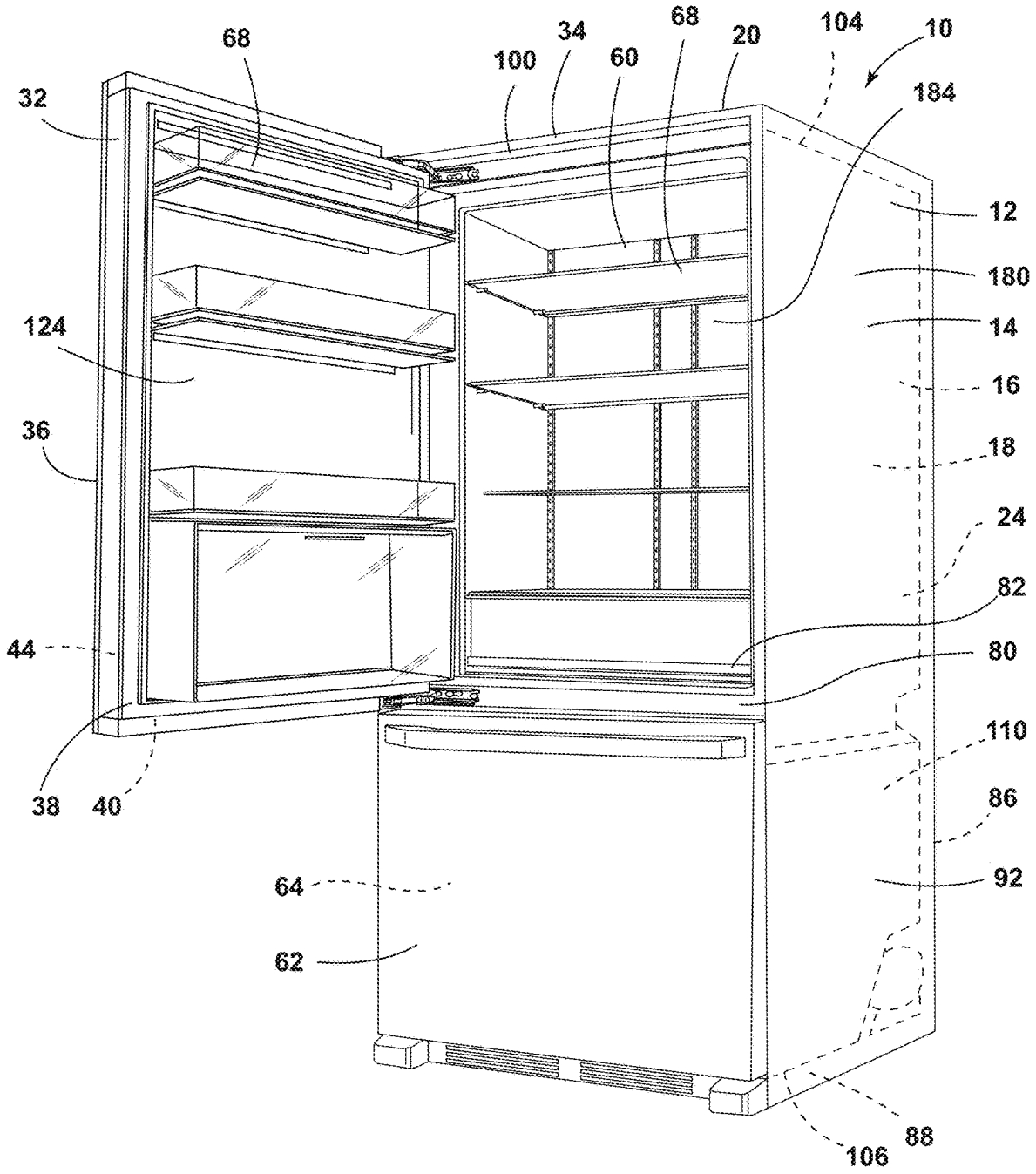
FIG. 1 is a front perspective view of a vacuum insulated appliance with a door assembly, according to the present disclosure.

The components in the figures are not necessarily to scale, emphasis instead being placed upon illustrating the principles described herein.

DETAILED DESCRIPTION

The present illustrated embodiments reside primarily in combinations of method steps and apparatus components related to a vacuum insulated appliance. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises a." does not, without more constraints, preclude the existence of additional identical elements in the process, method, article, or apparatus that comprises the element.

Referring to FIGS. 1-10, reference numeral 10 generally designates an appliance that includes a cabinet 12. The cabinet 12 includes an outer wrapper 14 and an inner liner 16 coupled to the outer wrapper 14. A vacuum insulated cavity 18 is defined between the outer wrapper 14 and the inner liner 16. A trim breaker 20 is coupled to the outer wrapper 14 and the inner liner 16, and the trim breaker 20 seals the vacuum insulated cavity 18. An evacuation port 22, also referred to as a wrapper evacuation port 22, is defined by the outer wrapper 14. The evacuation port 22 is in fluid communication with the vacuum insulated cavity 18 for evacuating air from the vacuum insulated cavity 18. A first porous foam 24 is coupled to an inner surface 26 of the outer wrapper 14. The first porous foam 24 defines a first plurality of pores 28. The first plurality of pores 28 defines a first airflow path 30 in fluid communication with the evacuation port 22.

A door assembly 32 is coupled to a front portion 34 of the cabinet 12. The door assembly 32 includes a door wrapper 36. A door liner 38 is coupled to the door wrapper 36. A door vacuum insulated cavity 40 is defined between the door wrapper 36 and the door liner 38. A door evacuation port 42 is defined by the door liner 38. The door evacuation port 42 is in fluid communication with the door vacuum insulated cavity 40 for evacuating air from the door vacuum insulated cavity 40. A second porous foam 44 is coupled to an interior surface 46 of the door wrapper 36. The second porous foam 44 defines a second plurality of pores 48. The second plurality of pores 48 defines a second airflow path 50 in fluid communication with the door evacuation port 42.

Figure 2:
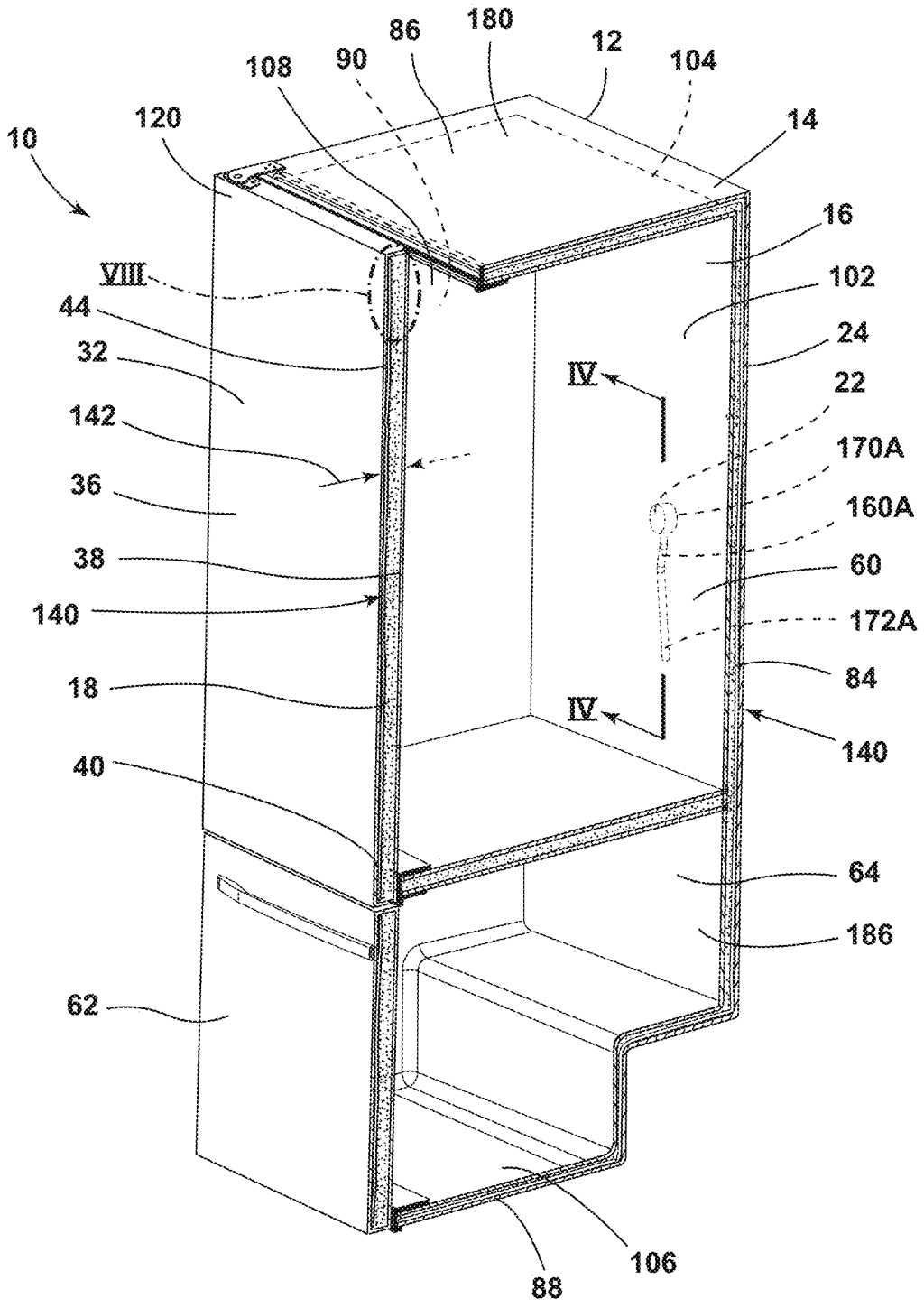
FIG. 2 is a cross-sectional view of a vacuum insulated appliance with a door assembly, according to the present disclosure.
Figure 3:
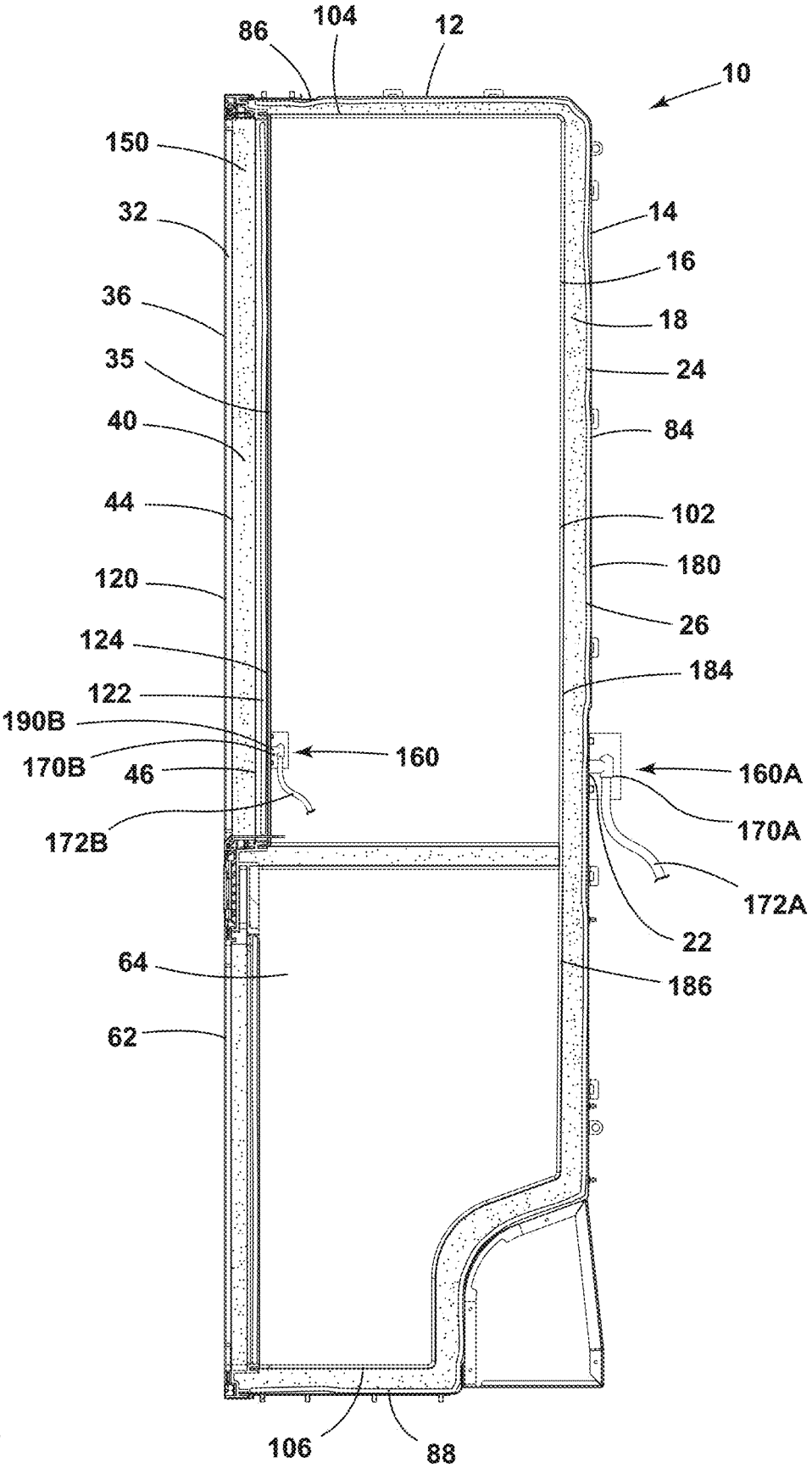
FIG. 3 is a cross-sectional view of a vacuum insulated appliance with a door assembly, showing evacuation port assemblies, according to the present disclosure.

Referring to FIGS. 1-3, the appliance 10 is illustrated as a refrigerator appliance, however, it is contemplated that the cabinet 12 with the outer wrapper 14, the inner liner 16, and the vacuum insulated cavity 18 may be used with a variety of appliances, structures, or insulation purposes other than with an appliance. Moreover, the illustrated refrigerating appliance 10 is a bottom-mount refrigerator. In non-limiting examples, the refrigerating appliance 10 can be a bottom-mount refrigerator, a bottom-mount French door refrigerator, a top-mount refrigerator, a side-by-side refrigerator, a four-door French door refrigerator, and/or a five-door French door refrigerator, each of which can have one or more door assemblies 32.

With reference still to FIG. 1, the illustrated appliance 10 includes the door assembly 32 that is pivotably coupled to the cabinet 12. The door assembly 32 is operable between open and closed positions and selectively provides access to a refrigerator compartment 60. The appliance 10 also includes a lower pull-out drawer 62 that defines or provides access to a freezer compartment 64. It will generally be understood that the features, as set forth herein, could be applied to any appliance having any general configuration. Further, the door assembly 32 configuration of the appliance 10 can vary from that shown in FIG. 1. The door assembly 32, as illustrated in FIG. 1, includes a handle 66 configured to allow a user to move the door assembly 32 between the opened and closed positions. The refrigerator compartment 60 and the freezer compartment 64 include shelving 68, as shown in FIG. 1, that can be adjusted and moved, depending on consumer preference. It is also generally contemplated that the door assembly 32 disclosed herein may be used with a variety of appliances, structures, or insulation purposes other than with an appliance.

The cabinet 12 is a vacuum insulated cabinet. As illustrated in FIGS. 1-4, the cabinet 12 includes the outer wrapper 14 coupled with the inner liner 16 to define the vacuum insulated cavity 18 therebetween. The outer wrapper 14 and the inner liner 16 may alternatively be referred to as a structural wrapper that defines the vacuum insulated cavity 18. The door assembly 32 is a vacuum insulated door assembly. The door assembly 32 includes the door wrapper 36 coupled with the door liner 38 to define the door vacuum insulated cavity 40 therebetween.

In the depicted example of FIG. 1, the cabinet 12 includes the outer wrapper 14 that is coupled to the inner liner 16 and the trim breaker 20 to define the vacuum insulated cavity 18, which may alternatively be referred to as the cabinet vacuum insulated cavity 18. The outer wrapper 14 includes a front edge 80 defining an opening 82, a rear panel 84 opposing the front edge 80, a top panel 86 and an opposing bottom panel 88 between the front edge 80 and the rear panel 84, and a first side panel 90 and an opposing second side panel 92 between the front edge 80 and the rear panel 84. The outer wrapper 14 may be made from a material at least partially resistant to bending, deformation, or otherwise being formed in response to an inward compressive force 94. These materials for the outer wrapper 14 include, but are not limited to, metals, polymers, metal alloys, combinations thereof, and/or other similar substantially rigid materials that can be used for vacuum insulated structures.

Referring further to FIGS. 1 and 2, the inner liner 16 is at least partially enclosed by the outer wrapper 14. The inner liner 16 includes a front edge 100, a rear section 102 that opposes the front edge 100, a top section 104 and an opposing bottom section 106 between the front section 100 and the rear section 102, and a first side section 108 and an opposing second side section 110 between the top section 104 and the bottom section 106. Further, as illustrated in FIG. 2, the inner liner 16 may have intermediate sections extending between the refrigerator and freezer compartments 60, 64. One intermediate section may form a lower portion of the refrigerator compartment 60, with a second intermediate section may form an upper portion of the freezer compartment 64. The intermediate sections extend from the front edge 100 to the rear section 102 and are configured to separate the compartments 60, 64 and define a mullion region therebetween. In such configurations, the inner liner 16 may be multiple components.

As illustrated in FIGS. 1-3, each section 100, 102, 104, 106, 108, 110 of the inner liner 16 may be proximate a respective panel 80, 84, 86, 88, 90, 92 of the outer wrapper 14. Similarly, each section 100, 102, 104, 106, 108, 110 of the inner liner 16 may have a shape and size that coincides with the shape and size of the respective panel 80, 84, 86, 88, 90, 92 of the outer wrapper 14. The inner liner 16 may be made from a material at least partially resistant to bending, deformation, or otherwise being formed in response to the inward compressive force 94. These materials for the inner liner 16 include, but are not limited to, metals, polymers, metal alloys, combinations thereof, and/or other similar substantially rigid materials that can be used for vacuum insulated structures.

The trim breaker 20 couples to the outer wrapper 14 to the inner liner 16 to define and seal the vacuum insulated cavity 18. The trim breaker 20 is generally disposed proximate the opening 82 of the outer wrapper 14. The trim breaker 20 includes one or more channels that receive the front edge 80 of the outer wrapper 14 and the front edge 100 of the inner liner 16. An adhesive is then disposed within one or more of the channels to couple the front edge 80 of the outer wrapper 14 and the front edge 100 of the inner liner 16 to the trim breaker 20 such that a sealed interface is defined. The outer wrapper 14, the inner liner 16, and the trim breaker 20 are sealed and airtight such that air can neither escape nor enter into the vacuum insulated cavity 18 between the outer wrapper 14 and the inner liner 16.

Referring still to FIGS. 1-3, the door assembly 32 is shown coupled to the cabinet 12. The door assembly 32 includes the door wrapper 36 that is coupled to the door liner 38 to define the door vacuum insulated cavity 40. The door wrapper 36 and the door liner 38 may alternatively be referred to as a door structural wrapper that defines the door vacuum insulated cavity 40. The door wrapper 36 includes an exterior surface 120 facing outward from the cabinet 12 and an interior surface 122 opposing the exterior surface 120, generally facing the door vacuum insulated cavity 40. The door liner 38 likewise defines an exterior surface 124 configured to face the refrigerator compartment 60 when the door assembly 32 is closed, and an interior surface 46 that opposes the door liner 38 exterior surface 124, generally facing the door vacuum insulated cavity 40.

According to various aspects, the interior surface 122 of the door wrapper 36 and the interior surface 46 of the door liner 38 at least partially enclose the door vacuum insulated cavity 40. The door wrapper 36 and the door liner 38 may be made from a material at least partially resistant to bending, deformation, or otherwise being formed in response to the inward compressive force 94. These materials for the door wrapper 36 and the door liner 38 include, but are not limited to, metals, polymers, metal alloys, combinations thereof, and/or other similar substantially rigid materials that can be used for vacuum insulated structures.

Referring further to FIG. 2, an at least partial vacuum 140 is defined within the vacuum insulated cavity 18 and the door vacuum insulated cavity 40. In the cabinet 12, the at least partial vacuum 140 defines a pressure differential 142 between an environment external to the cabinet 12 and the vacuum insulated cavity 18. Similarly, in the door assembly 32, the at least partial vacuum 140 defines the pressure differential 142 between an environment external to the door assembly 32 and the door vacuum insulated cavity 40. The pressure differential 142 serves to define the inward compressive force 94 that is exerted on both the outer wrapper 14 and the inner liner 16 of the cabinet 12, and both the door wrapper 36 and the door liner 38 of the door assembly 32. The inward compressive force 94 tends to bias the outer wrapper 14 and the inner liner 16 towards the vacuum insulated cavity 18, and, similarly, the inward compressive force 94 tends to bias the door wrapper 36 and the door liner 38 towards the door vacuum insulated cavity 40. It is also contemplated that the pull-out drawer 62 may be a vacuum insulated door assembly constructed similarly to the door assembly 32.

Each of the vacuum insulated cavity 18 of the cabinet 12 and the door vacuum insulated cavity 40 of the door assembly 32 typically includes one or more insulation powders 150 disposed therein. It is generally contemplated that the insulation powder 150 may be a carbon-based powder, a glass-type powder, a silicon oxide-based powder, silica-based powders, and/or other standard insulation powders 150 known in the art. According to various aspects, the insulation power 150 includes a plurality of insulation particles. The insulation powder 150 substantially fills the vacuum insulated cavity 18 and the door vacuum insulated cavity 40, forming a substantially continuous layer in each cavity 18, 40. In the cabinet 12, the layer may be disposed between the first porous foam 24 and the inner liner 16. Likewise, in the door assembly 32, the layer may be disposed between the second porous foam 44 and the door wrapper 36.

To increase evacuation of fluid, while still ensuring the insulation powder 150 remains disposed within the vacuum insulated cavity 18, 40, respectively, the appliance 10 disclosed herein may incorporate the evacuation port 22 that is in fluid communication with the first porous foam 24, and the door evacuation port 42 that is in fluid communication with the second porous foam 44. In particular, the use of the first porous foam 24 and the second porous foam 44 permit more uniform and more efficient extraction of the gas from each vacuum insulated cavity 18, 40, while still filtering out the insulation powder 150 such that the insulation powder 150 is maintained within each vacuum insulated cavity 18, 40. Accordingly, while the gas is evacuated during the evacuation process, the insulation powder 150 is not.

Figure 4:
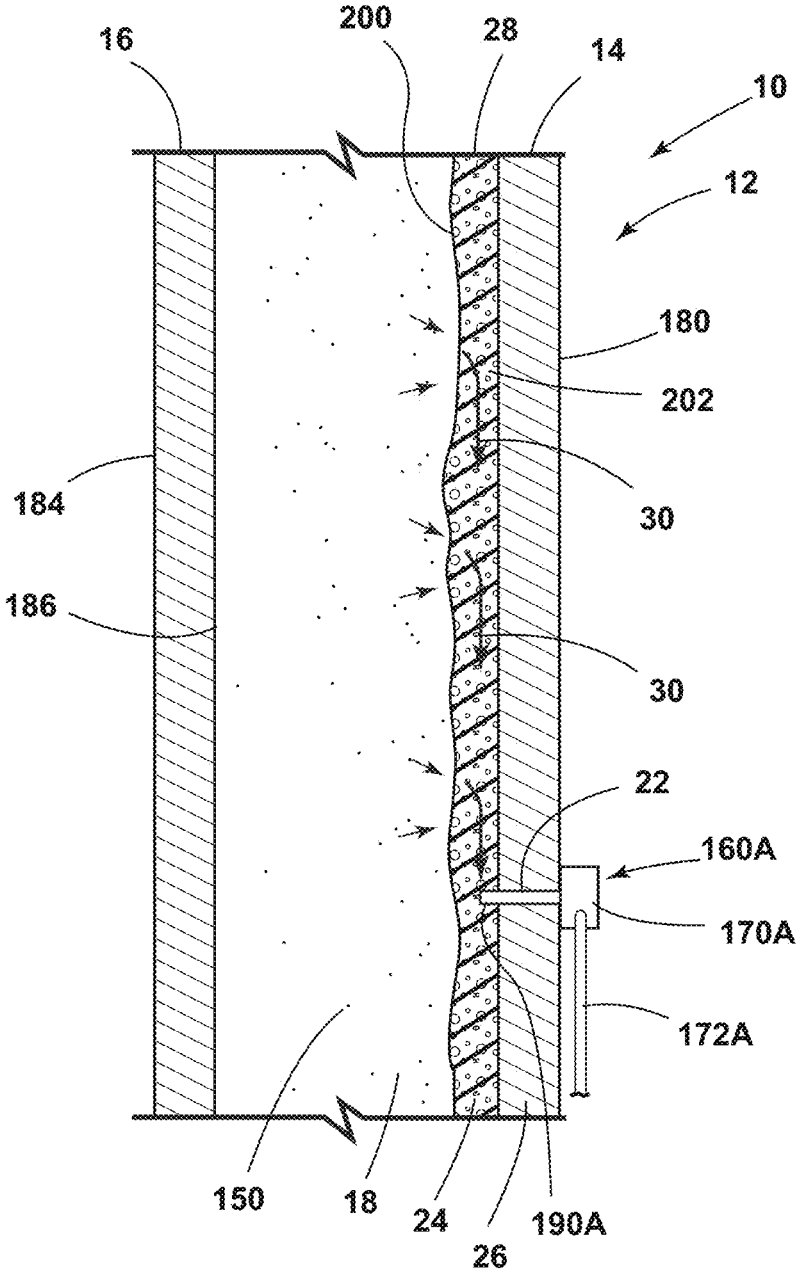
FIG. 4 is a cross-sectional view of a portion of a cabinet of the vacuum insulated appliance of FIG. 2, taken along the line IV-IV, according to the present disclosure.
Figure 5:
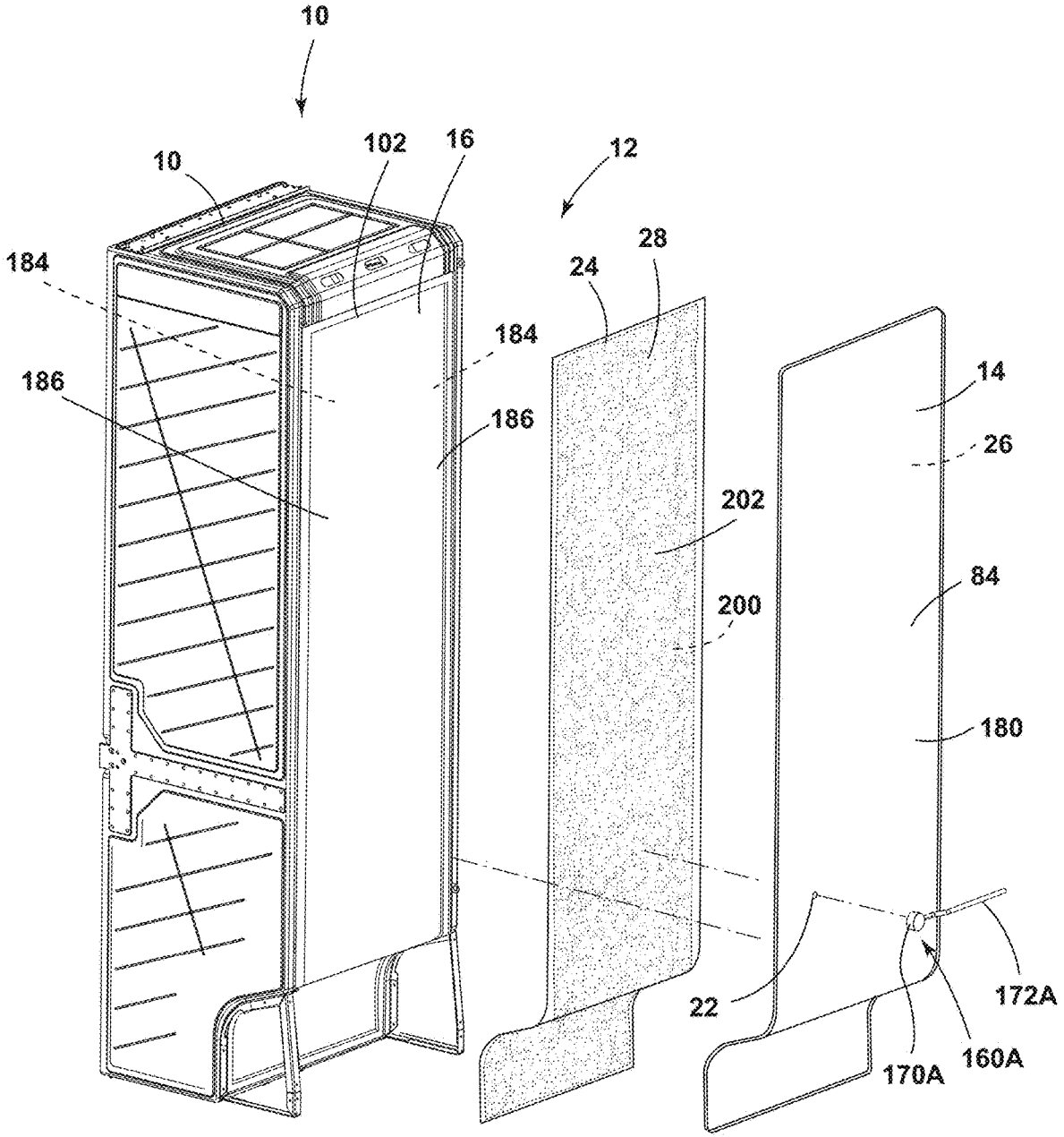
FIG. 5 is an exploded side perspective view of a rear panel of a cabinet of a vacuum insulated appliance, according to the present disclosure.

Referring still to FIG. 3, as well as FIG. 4, the appliance 10 defines one or more evacuation ports 22, 42. In the illustrated example, the outer wrapper 14 defines the evacuation port 22, which is an opening into the vacuum insulated cavity 18. The evacuation port 22 may be alternatively referred to as the cabinet evacuation port and/or the wrapper evacuation port. The at least partial vacuum 140 within the vacuum insulated cavity 18 is typically defined by evacuation of gas through the evacuation port 22 via an evacuation port assembly 160A operably disposed in the evacuation port 22.

The door assembly 32 defines one or more door evacuation ports 42. In the illustrated example, the door liner 38 defines the door evacuation port, which is an opening into the door vacuum insulated cavity 40. The at least partial vacuum 140 within the door vacuum insulated cavity 40 is typically defined by evacuation of gas through the door evacuation port 42 via the evacuation port assembly 160B.

It is generally contemplated that the appliance 10 may include a plurality of evacuation port assemblies 160A, 160B disposed throughout the appliance 10. For example, the appliance 10 may include a first evacuation port assembly 160A coupled to the evacuation port 22 and a second evacuation port assembly 160B coupled to the door evacuation port 42. In such examples, both evacuation port assemblies 160A, 160B may have a structure and size that coincides with or differs from the other evacuation port assembly 160A, 160B. For example, the first evacuation port assembly 160A may be of a greater size than the second evacuation port assembly 160B. According to various aspects, both evacuation port assemblies 160A, 160B are coupled to the outer wrapper 14 and the door liner 38, respectively, before bonding the porous foams 24, 44 to the outer wrapper 14 and the door liner 38.

The first evacuation port assembly 160A includes a base 170A and a service tube 172A extending from the base 170A. In various aspects, the first evacuation port assembly 160A is in fluid communication with the vacuum insulated cavity 18 via the evacuation port 22 to expel gas from the vacuum insulated cavity 18.

The base 170A of the first evacuation port assembly 160A may be coupled to the outer wrapper 14 and is adjacent to the evacuation port 22. Typically, the base 170A extends over and surrounds the evacuation port 22. The base 170A may be coupled to an outer surface 180 or the inner surface 26 of the outer wrapper 14. It is also generally contemplated that the base 170A may be coupled to the inner liner 16. For example, the base 170A may be coupled to an outer surface 184 or an inner surface 186 of the inner liner 16.

As illustrated in FIGS. 2-5, the service tube 172A extends from the base 170A and is external from the vacuum insulated cavity 18. The service tube 172A is in fluid communication with the vacuum insulated cavity 18. The service tube 172A defines an evacuation path such that gas can be exhausted from the vacuum insulated cavity 18.

Referring further to FIG. 4, the first evacuation port assembly 160A may include an evacuation shaft 190A to aid in the removal of gas from the vacuum insulated cavity 18. The evacuation shaft 190A may extend from the base 170A, through the evacuation port 22 and into the vacuum insulated cavity 18.

According to various examples, the evacuation shaft 190A may include one or more apertures that are in fluid communication with the vacuum insulated cavity 18. For example, the evacuation shaft 190A may include one or more apertures disposed along a length of the evacuation shaft 190A, or the evacuation shaft 190A may include a central end opening. Additionally, or alternatively, it is generally contemplated that the evacuation port assembly 160A may include various other components for aiding in the removal and/or filtration of gasses from the vacuum insulated cavity 18. For example, filter paper or a mesh screen may be disposed over the evacuation port 22.

Similarly, the second evacuation port assembly 160B includes a base 170B and a service tube 172B extending from the base 170B. In various aspects, the second evacuation port assembly 160B is in fluid communication with the door vacuum insulated cavity 40 via the door evacuation port 42 to expel gas from the door vacuum insulated cavity 40.

The base 170B of the second evacuation port assembly 160B may be coupled to the door liner 38 and is adjacent to the door evacuation port 42. Typically, the base 170B extends over and surrounds the door evacuation port 42. The base 170B may be coupled to the exterior surface 120 or the interior surface 122 of the door wrapper 36, or that the base 170B may be coupled to the exterior surface 124 or the interior surface 46 of the door liner 38.

The service tube 172B of the second evacuation port assembly 160B extends from the base 170B and is external from the door vacuum insulated cavity 40. The service tube 172B is in fluid communication with the door vacuum insulated cavity 40. The service tube 172B defines an evacuation path such that gas can be exhausted from the door vacuum insulated cavity 40. The second evacuation port assembly 160B may include an evacuation shaft 190B to aid in the removal of gas from the door vacuum insulated cavity 40. The evacuation shaft 190B may extend from the base 170B, through the door evacuation port 42, and into the door vacuum insulated cavity 40.

According to various examples, the evacuation shaft 190B may include one or more apertures that are in fluid communication with the door vacuum insulated cavity 40. For example, the evacuation shaft 190B may include one or more apertures disposed along a length of the evacuation shaft 190B, or the evacuation shaft 190B may include a central end opening. Additionally, or alternatively, it is generally contemplated that the evacuation port assembly 160B may include various other components for aiding in the removal and/or filtration of gasses from the door vacuum insulated cavity 40. For example, filter paper or a mesh screen may be disposed over the door evacuation port 42.

Referring again to FIGS. 2-5, the first porous foam 24 is disposed within the vacuum insulated cavity 18. In the illustrated example, the first porous foam 24 is shown disposed within the vacuum insulated cavity 18 and coupled to the inner surface 26 of the outer wrapper 14. Generally, the first porous foam 24 is directly bonded to the inner surface 26. For example, the first porous foam 24 may be a spray foam that is applied to the inner surface 26 of the outer wrapper 14. The first porous foam 24 may bond to the inner surface 26 of the outer wrapper 14 during a curing process. For example, the first porous foam 24 can be sprayed to the outer wrapper 14 in an uncured state. The first porous foam 24 may then cure to the outer wrapper 14, wherein during the curing process, the first porous foam 24 bonds to the inner surface 26 of the outer wrapper 14. In various aspects, the first porous foam 24 may be bonded to various surfaces within the vacuum insulated cavity 18, such as the inner surface 186 of the inner liner 16.

According to various aspects, the first porous foam 24 may be disposed in the vacuum insulated cavity 18 such that the first porous foam 24 extends along a portion or an entirety of the inner surface 26 of the outer wrapper 14 and/or the inner surface 186 of the inner liner 16. In some examples, the first porous foam 24 may be the spray foam that is bonded to the inner surface 26 of the outer wrapper 14 and extends along an entirety of the inner surface of the outer wrapper 14.

In various aspects, the first porous foam 24 may be bonded to various areas of the cabinet 12. For example, the first porous foam 24 can be bonded to the rear panel 84 of the outer wrapper 14, which may be advantageous when the evacuation port 22 is defined in the rear panel 84. In additional aspects, the first porous foam 24 may be disposed in the vacuum insulated cavity 18 such that one or more patterns are defined. For example, the first porous foam 24 may include a plurality of foam strips extending along the vacuum insulated cavity 18. In such examples, the plurality of foam strips may individually, as a group, and/or as an entirety, define various patterns, such as a grid pattern, an X-pattern, and/or other various patterns.

Figure 6:
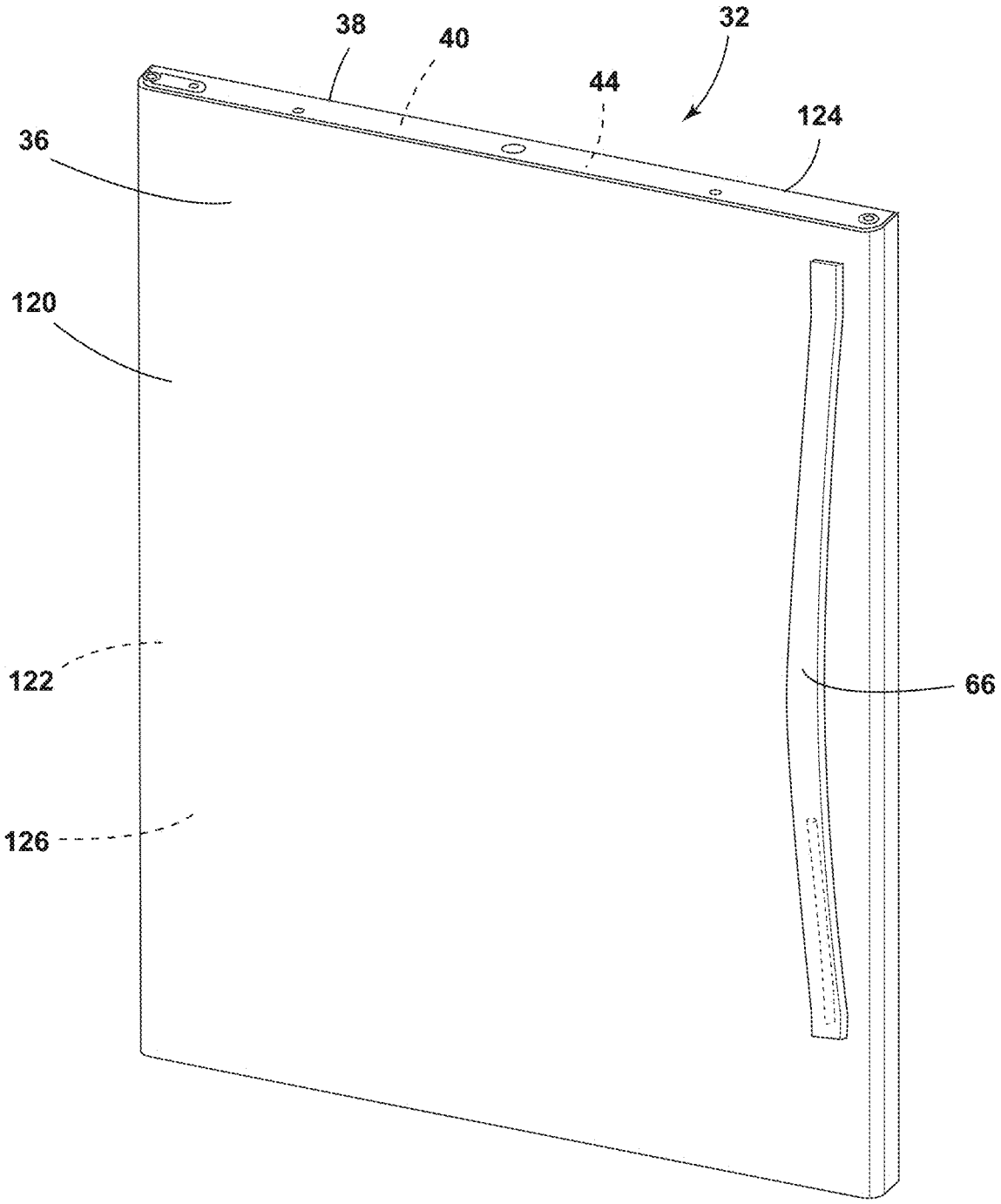
FIG. 6 is a front perspective view of a vacuum insulated door assembly for an appliance, according to the present disclosure.
Figure 7:
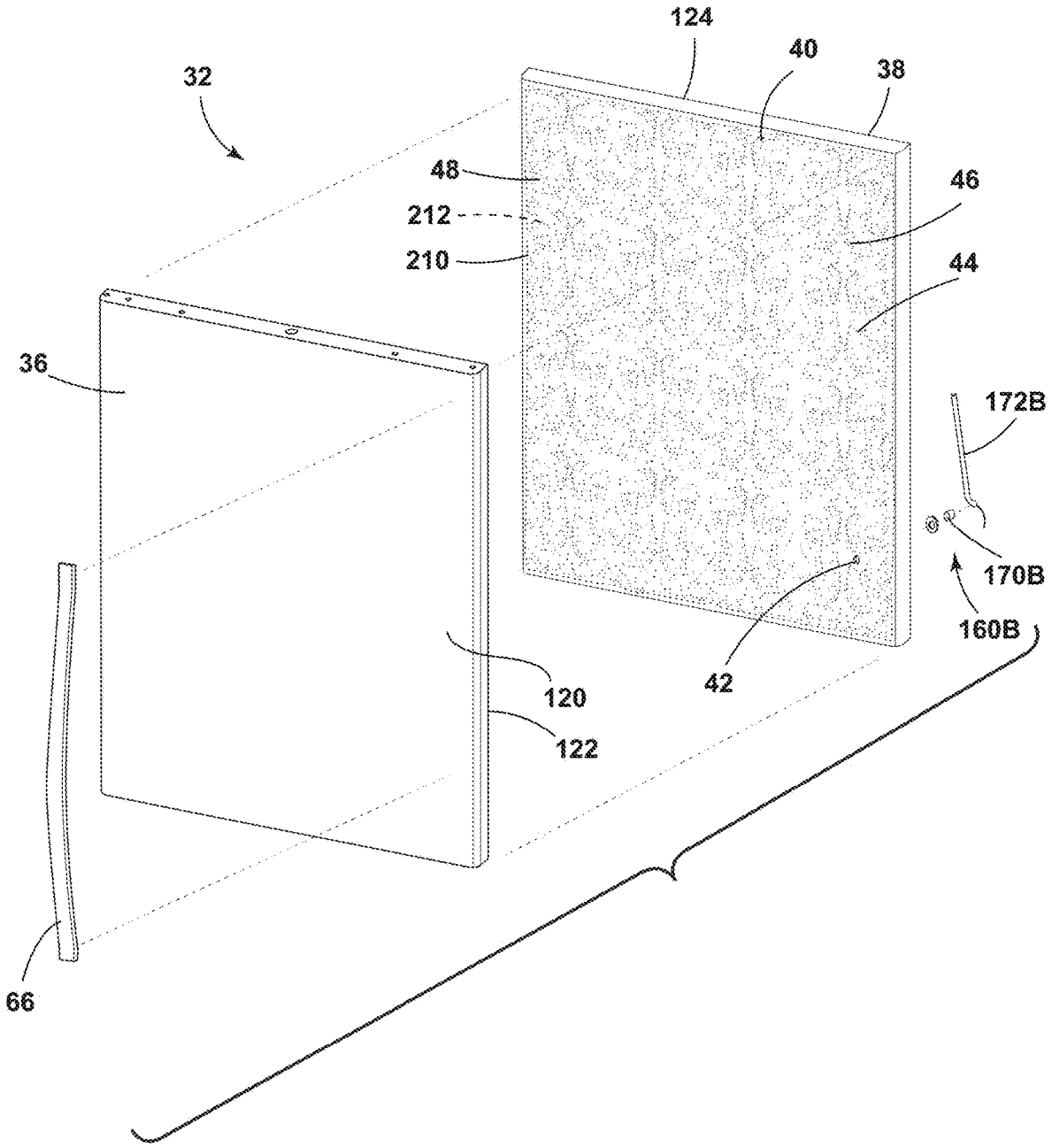
FIG. 7 is an exploded side perspective view of a vacuum insulated door assembly, according to the present disclosure.
Figure 8:
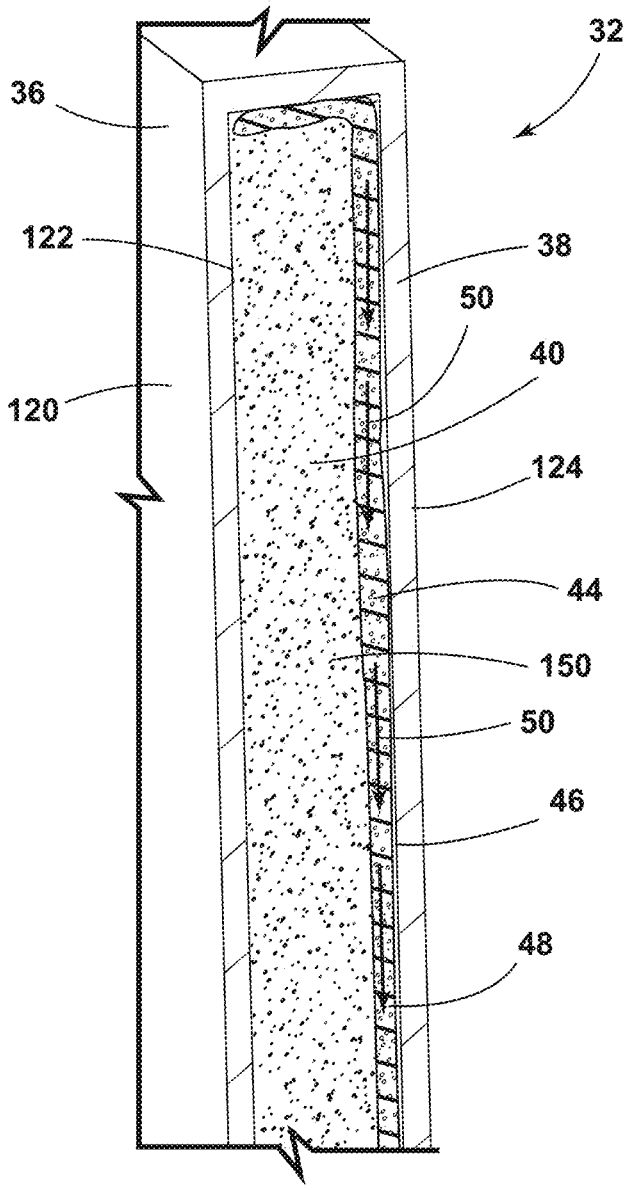
FIG. 8 is a partial cross-sectional view of a vacuum insulated door assembly, according to the present disclosure.

Referring still to FIGS. 2 and 3, as well as FIGS. 6-8, the second porous foam 44 is disposed within the door vacuum insulated cavity 40. In the illustrated example, the second porous foam 44 is shown disposed within the door vacuum insulated cavity 40 and coupled to the interior surface 46 of the door liner 38. In some examples, the second porous foam 44 is directly bonded to the interior surface 46 of the door liner 38. For example, the second porous foam 44 can be sprayed on the door liner 38 in an uncured state. The second porous foam 44 may then cure to the door liner 38, wherein during the curing process, the second porous foam 44 bonds to the door liner 38. In various aspects, the second porous foam 44 may be bonded to various surfaces within the door vacuum insulated cavity 40, such as the interior surface 122 of the door wrapper 36.

According to various aspects, the second porous foam 44 may be disposed in the door vacuum insulated cavity 40 such that the second porous foam 44 extends along a portion or an entirety of the interior surface 46 of the door liner 38 or the interior surface of the door wrapper 36. In certain aspects, the second porous foam 44 may be a spray foam that is bonded to the interior surface 46 of the door liner 38 and extends along an entirety of the inner surface 46 of the door liner 38.

Additionally, or alternatively, the second porous foam 44 may be bonded to various areas of the door assembly 32. For example, the second porous foam 44 can be bonded to a central region of the door liner 38, which may align with the door evacuation port 42. In additional aspects, the second porous foam 44 may be disposed in the door vacuum insulated cavity 40 such that one or more patterns are defined. For example, the second porous foam 44 may include a plurality of foam strips extending along the door vacuum insulated cavity 40. In such examples, the plurality of foam strips may individually, as a group, and/or as an entirety, define various patterns, such as a grid pattern, an X-pattern, and/or other various patterns.

According to various aspects, the thickness of the first porous foam 24 and the second porous foam 44 may be one of multiple thicknesses. Generally, the first porous foam 24 may have a thickness that is less than the space between the inner surface 26 of the outer wrapper 14 and the inner surface 186 of the inner liner 16, and the second porous foam 44 may have a thickness that is less than the space between the door wrapper 36 interior surface 122 and the door liner 38 interior surface 46. For example, the first porous foam 24 and/or the second porous foam 44 may have a thickness of about 5 millimeters (mm). In some examples, the first porous foam 24 may have a thickness that is equal to or less than a thickness of the outer wrapper 14 and/or the inner liner 16. Similarly, the second porous foam 44 may have a thickness that is equal to or less than the thickness of the door wrapper 36 and/or the door liner 38.

In various aspects, the first porous foam 24 and/or the second porous foam 44 may define multiple thicknesses. For example, either porous foam 24, 44 may have a first region with a greater thickness than a second, central region. In such examples, it is contemplated that the varying thicknesses of either porous foam 24, 44 may define one or more gas extraction channels within the vacuum insulated cavity 18 and/or the door vacuum insulated cavity 40. According to various aspects, where either porous foam 24, 44 is a spray foam, the thickness of either porous foam 24, 44 may be determined by the amount of spray foam applied to various sections of the cabinet 12 and/or door assembly 32.

Referring again to FIGS. 4 and 5, and still to FIGS. 7 and 8, the first porous foam 24 and the second porous foam 44 may each be configured as an open-cell foam that defines a plurality of pores. For example, the first porous foam 24 may be an open-cell foam that defines the first plurality of pores 28 and the second porous foam 44 may be an open-cell foam that defines the second plurality of pores 48. It is also generally contemplated that the first porous foam 24 and/or the second porous foam 44 may define a partially open-cell foam or a foam having regions of open-cell foam and closed-cell foam.

The first plurality of pores 28 of the first porous foam 24 may define at least one airflow path 30 that is in fluid communication with the vacuum insulated cavity 18 and the evacuation port 22. For example, the first porous foam 24 may be an open-cell foam that defines the first airflow path 30 from an outer region 200 of the first porous foam 24, which is distal from the inner surface 26 of the outer wrapper 14 and in contact with gasses retained within the vacuum insulated cavity 18, to an inner region 202 of the first porous foam 24, which is proximate the inner surface 26 and extends to the evacuation port 22. In such examples, the gasses are evacuated out of the vacuum insulated cavity 18 by being pulled along the first airflow path 30, which pulls the gas from the vacuum insulated cavity 18, through the first porous foam 24, and out of the evacuation port 22, where the gas is then expelled out of the appliance 10.

According to various aspects, the first airflow path 30 generally directs the fluid being evacuated towards the evacuation port 22. In some examples, the first airflow path 30 may be defined such that the fluid flows in a direction parallel to the outer wrapper 14 and/or the inner liner 16. For example, the first plurality of pores 28 may generally align with one another such that the first airflow path 30 travels parallel to the outer wrapper 14. In this way, the gas from distal locations, such as upper and lower portions of the cabinet 12 may flow through the first airflow path 30 of the porous foam, generally parallel to the outer wrapper 14 to the evacuation port 22.

In various aspects, the first plurality of pores 28 may define a plurality of first airflow paths. For example, the first airflow path 30 may include a plurality of airflow channels that are each in communication with the vacuum insulated cavity 18 and the evacuation port 22. In such examples, the plurality of airflow channels of the first airflow path 30 permits the more uniform evacuation of gas out of the vacuum insulated cavity 18 due to the gas being more uniformly pulled along a plurality of inlet points and airflow channels that collectively direct the gas towards the evacuation port 22.

Further, in such examples, the gas being uniformly pulled along at the plurality of inlet points may flow in various directions. For example, gas being uniformly pulled at an inlet point that is distal from the evacuation port 22 may flow perpendicular to the inner surface 26 of the outer wrapper 14 as the gas enters the inlet point. The gas may then be pulled parallel to the inner surface 26 and combined with other gases, where the combined gas then travels to the evacuation port 22. Additionally, or alternatively, the first porous foam 24 can be an open-cell foam and the plurality of channels can be defined by the open-cell structure of the first porous foam 24. In such examples, the plurality of airflow channels may be defined by various factors such as, pores per cell, permeability of the porous foam, and/or various other factors.

The second plurality of pores 48 of the second porous foam 44 may likewise define at least one airflow path 50 that is in fluid communication with the door vacuum insulated cavity 40 and the door evacuation port 42. For example, the second porous foam 44 may be an open-cell foam that defines the second airflow path 50 from an outer region 210 of the second porous foam 44, which is in contact with gasses retained within the door vacuum insulated cavity 40, to an inner region 212 of the second porous foam 44, which extends to the door evacuation port 42. In such examples, the gasses are evacuated out of the door vacuum insulated cavity 40 by being pulled along the second airflow path 50, which pulls the gas from the door vacuum insulated cavity 40, through the second porous foam 44, and out of the door evacuation port 42, where the gas is then expelled out of the door assembly 32.

According to various aspects, the second airflow path 50 generally directs the fluid being evacuated towards the door evacuation port 40. In some examples, the second airflow path 50 may be defined such that the fluid flows in a direction parallel to the door wrapper 36 and/or the door liner 38. For example, the second plurality of pores 48 may generally align with one another such that the second airflow path 50 travels parallel to the outer wrapper 14. The airflow path 50 may direct the gas in various directions as the gas flows towards the door evacuation port 42. For example, the second airflow path 50 may be defined such that the gas flows in a direction parallel to the door wrapper 36 and/or the door liner 38. In this way, the gas from distal locations in the door assembly 32 may be drawn into the second porous foam 44, flow along the second airflow path 50, and be expelled through the door evacuation port 40.

In various aspects, the second plurality of pores 48 may define a plurality of airflow paths. For example, the second airflow path 50 may include a plurality of airflow paths or channels that are each in connection with the door vacuum insulated cavity 40 and the door evacuation port 42. In such examples, the plurality of airflow channels of the second airflow path 50 permit the more uniform evacuation of gas out of the door vacuum insulated cavity 40 due to the gas being more uniformly pulled along a plurality of inlet points and airflow paths and towards the door evacuation port 42. Further, in such examples, the gas being more uniformly pulled along at the plurality of inlet points may flow in various directions. For example, gas being uniformly pulled at an inlet point that is distal from the door evacuation port 42 may flow perpendicular to the interior surface 46 of the door liner 38 as the gas enters the inlet point. The gas may then be pulled parallel to the interior surface 46 and combined with other gasses, where the combined gas then travels to the door the evacuation port 42. Additionally, or alternatively, the second porous foam 44 may be an open-cell foam and the plurality of channels may be defined by the open-cell structure of the second porous foam 44. In such examples, the plurality of airflow channels may be defined by various factors such as, pores per cell, permeability of the porous foam, and/or various other factors.

According to various aspects, each pore of the first plurality of pores 28 and the second plurality of pores 48 has a width that is less than a width of each particle of the insulation powder 150. In particular, each pore may have a width of 5 microns (μm) or less. The lessened width of each pore relative to each particle of the insulation powder 150 is such that gasses within the vacuum insulated cavity 18 and the door vacuum insulated cavity 40 may pass through each pore while each insulation particle is prevented from passing through each pore. In this respect, the first plurality of pores 28 and the second plurality of pores 48 may serve as a filter for larger particles, such as the particles of the insulation powder 150.

It is generally contemplated that each cell of the first porous foam 24 and the second porous foam 44 may define one or more pores per cell. In some examples, the first porous foam 24 and/or the second porous foam 44 may define channels within the porous foam for the flow of gas by having regions with varying numbers of pores per cell. For example, the first porous foam 24 and/or the second porous foam 44 may have a central region, where each cell in the central region has a greater number of pores per cell such that gases may flow at a greater rate in the central region. In such examples, the greater number of pores and the greater flow rate of gas is such that the central region defines a channel with a greater flow rate. It is also generally contemplated that each pore of the first plurality of pores 28 and/or the second plurality of pores 48 may have a width that varies or is consistent with the other pores of the first plurality of pores 28 and/or the second plurality of pores 48.

The first porous foam 24 and the second porous foam 44 may be formed from various materials. For example, each porous foam 24, 44 may be made out of a reticulated form, a polyurethane foam, an open cell rubber, other various polymers, and/or combinations thereof. According to various aspects, the first porous foam 24 and the second porous foam 44 may be substantially rigid or elastic, with varying levels of material toughness. For example, the first porous foam 24 and/or the second porous foam 44 may be rigid with a greater degree of material toughness such that the first porous foam 24 and/or the second porous foam 44 stays in a static state as gas is evacuated out of the vacuum insulated cavity 18 or the door vacuum insulated cavity 40. In various examples, this high rigidity and material toughness may be advantageous for maintaining flow paths during the evacuation of gas and/or during a subsequent evacuation of gas, as well as providing strength to the cabinet 12 or door assembly 32.

In another example, the first porous foam 24 and/or the second porous foam 44 may be rigid with a lesser degree of material toughness such that each cell of either porous foam 24, 44 progressively closes as gas is evacuated out of the vacuum insulated cavity 18. In such examples, the first porous foam 24 and/or the second porous foam 44 may have a first thickness of about 5 mm before the gas is evacuated from the vacuum insulated cavity 18 or the door vacuum insulated cavity 40, and then a second thickness of about 0.4 mm after the gas is evacuated from the vacuum insulated cavity 18 and/or the door vacuum insulated cavity 40.

In various aspects, this lessened rigidity of the porous foam 24, 44 may advantageously provide for an open-cell foam that assists in evacuating fluid from either vacuum insulated cavity 18, 40, while also increasing a width of the vacuum insulated cavity 18, 40, which in turn may reduce thermal transfer between an external environment and the interior of either vacuum insulated cavity 18, 40. In some examples, this lessened rigidity may be due to a rapidly curing open-cell foam. In such examples, the rapidly curing open-cell foam may advantageously permit increased efficiency in the manufacture of the appliance 10. It is also generally contemplated that the first porous foam 24 and/or the second porous foam 44 may be an elastic foam such that the first porous foam 24 and/or the second porous foam 44 compresses to varying degrees, depending on the magnitude of the inward compressive force 94.

Figure 9:
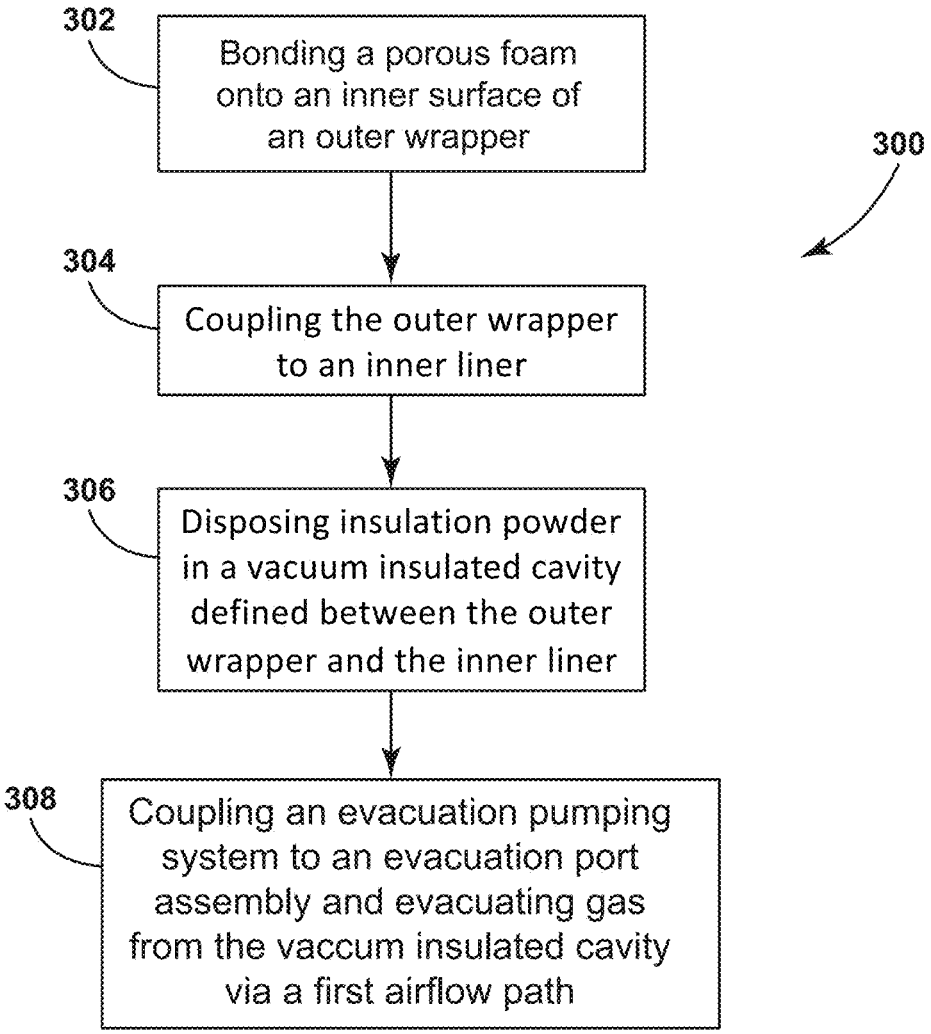
FIG. 9 is a flow diagram of a method of assembling a vacuum insulated cabinet, according to the present disclosure.

Referring to FIG. 9, as well as FIGS. 1-8, a method 300 of assembling the cabinet 12 includes step 302 of bonding the first porous foam 24 onto the inner surface 26 of the outer wrapper 14. The outer wrapper 14 is provided with the evacuation port assembly 160A coupled thereto over the evacuation port 22. In this way, the outer wrapper 14 is partially assembled prior to the first porous foam 24 being sprayed on the inner surface 26. In step 302, the outer wrapper 14 is provided and the first porous foam 24 is sprayed onto the inner surface 26 of the outer wrapper 14, where the first porous foam 24 is then cured and bonded to the outer wrapper 14.

In step 304, the outer wrapper 14 is then coupled to the inner liner 16 and the trim breaker 20 to form the cabinet 12 and seal the vacuum insulated cavity 18. In step 306, the insulation powder 150 is disposed in the vacuum insulated cavity 18 between the outer wrapper 14 and the inner liner 16.

In step 308, an evacuation pumping system is coupled to the servicing tube 172A of the evacuation port assembly 160A and gas is evacuated out of the vacuum insulated cavity 18 via the first airflow path 30. In the first airflow path 30, the gas is pulled from the vacuum insulated cavity 18 and passes through the first porous foam 24. The gas then flows out of the evacuation port 22, through the service tube 172A, and is expelled out of the cabinet 12. The service tube 172A can then be crimped to maintain the at least partial vacuum within the vacuum insulated cavity 18.

Figure 10:
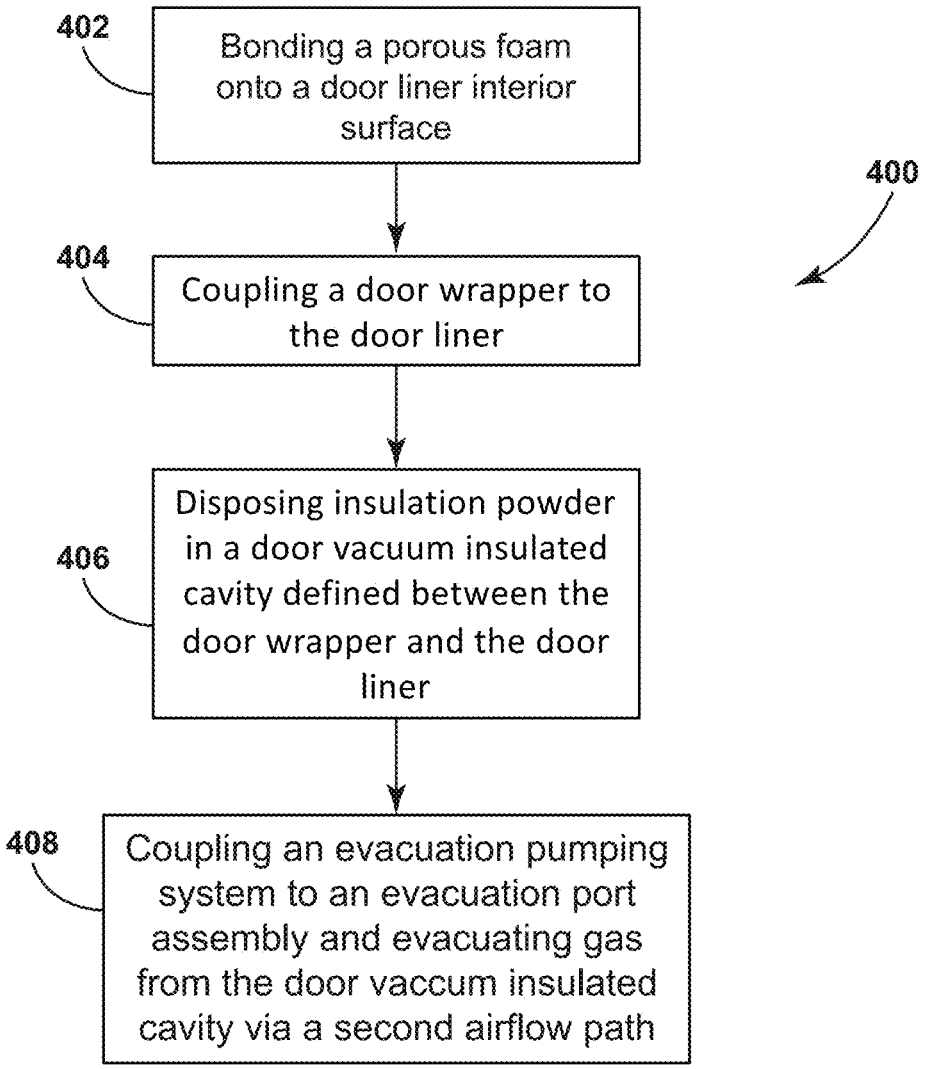
FIG. 10 is a flow diagram of a method of assembling a vacuum insulated door assembly, according to the present disclosure.

Referring to FIG. 10, as well as FIGS. 1-8, a method 400 of assembling the door assembly 32 includes step 402 of bonding the second porous foam 44 onto the interior surface 46 of the door liner 38. The door liner 38 is provided with the evacuation port assembly 160B coupled thereto over the door evacuation port 42. In this way, the door liner 38 is partially assembled prior to the second porous foam 44 being sprayed on the inner surface 46. In step 402, the door liner 38 is provided and the second porous foam 44 is sprayed onto the interior surface 46 of the door liner 38, where the second porous foam 44 is then cured and bonded to the door liner 38.

In step 404, the door liner 38 is coupled to the door wrapper 36 to seal the door vacuum insulated cavity 40. In step 406, the insulation powder 150 is disposed in the door vacuum insulated cavity 40 between the door wrapper 36 and the door liner 38.

In step 408, an evacuation pumping system is coupled to the servicing tube 172B of the evacuation port assembly 160B and gas is evacuated out of the door vacuum insulated cavity 40 via the second airflow path 50. In the second airflow path 50, the gas is pulled from the door vacuum insulated cavity 40 and passes through the second porous foam 44. The gas then flows out of the door evacuation port 42, through the service tube 172B, and is expelled out of the appliance 10. The service tube 172B can then be crimped to maintain the at least partial vacuum within the door vacuum insulated cavity 40. The steps 302-308, 402-408 of the methods 300, 400 may be performed simultaneously, performed in any order, omitted, and/or repeated without departing from the teachings herein.

Referring to FIGS. 1-10, the appliance 10 having the vacuum insulated cavity 18 with the first porous foam 24, and the door assembly 32 having the door vacuum insulated cavity 40 with the second porous foam 44, provides for an appliance 10 that can more uniformly extract air from either or both vacuum insulated cavity 18, 40, while still keeping the insulation powder 150 disposed in the vacuum insulated cavity 18 and the door vacuum insulated cavity 40. In particular, each pore of the first plurality of pores 28 of the first porous foam 24 and the second plurality of pores 48 of the second porous foam 44 has a width less than the width of each particle of the insulation powder 150. This difference in width between each pore and each particle is such that gas is permitted to pass through either porous foam 24, 44, through the first airflow path 30 and/or the second airflow path 50, while the insulation powder 150 is filtered out of either airflow path 30, 50 and maintained within the respective vacuum insulated cavity 18, 40. Moreover, the airflow paths 30, 50 decrease the time to fully evacuate the respective cavities 18, 40, thereby maximizing efficiency of the manufacturing process.

According to various examples, the vacuum insulated cabinet 12 and the vacuum insulated door assembly 32 can be used in various appliances. These appliances can include, but are not limited to, refrigerators, freezers, coolers, ovens, dishwashers, laundry appliances, and other similar appliances and fixtures within household and commercial settings. Additionally, the insulation powder 150 can be a free-flowing material that can be poured, blown, compacted, or otherwise disposed within either vacuum insulated cavity 18, 40.

Referring further to FIGS. 1-10, the present disclosure provides for a variety of advantages. For example, the use of the first porous foam 24 and the second porous foam 44 provides a filter such that gas may be evacuated from either vacuum insulated cavity 18, 40, without removing the insulation powder 150. Similarly, the filtration of the insulation powder 150 out of either airflow path 30, 40 advantageously provides for the increased rate of fluid evacuation, as fluid is permitted to freely flow through either porous foam 24, 44 without being encumbered by particles of the insulation powder 150.

Additionally, both porous foams 24, 44 advantageously provide for a more uniform and effective extraction of gas from either vacuum insulated cavity 18, 40, due to both porous foams 24, 44 being open-cell and defining the plurality of airflow paths that extract gas at multiple points along the outer region 200, 210 of either porous foam 24, 44. This more uniform extraction of gas likewise permits the reduction of evacuation ports 22 or door evacuation ports 42, as the gas may be more uniformly extracted from a single evacuation port 22 that is in fluid communication with the first porous foam 24 or from a single door evacuation port 42 that is in fluid communication with the second porous foam 44.

Similarly, the more uniform extraction of gas via the plurality of channels and plurality of inlet points defined by either porous foam 24, 44 advantageously provides for the evacuation of gas along a flow path 30, 50 that extends parallel to the outer wrapper 14 or the door liner 38. This parallel flow of the gas advantageously permits greater evacuation control and uniformity of gas evacuation, as the gas being evacuated combines and travels along a single flow path 30, 50. Furthermore, the use of the first porous foam 24 and the second porous foam 44 advantageously reduces the assembly time of the appliance 10 with the door assembly 32. In particular, by spraying the first porous foam 24 to the inner surface 26 of the outer wrapper 14 and the second porous foam 44 to the interior surface 46 of the door liner 38, both porous foams 24, 44 are quickly bonded, and airflow paths are provided, without additional manufacturing steps. Additional benefits or advantages of using this appliance 10 may also be realized and/or achieved.

The device disclosed herein is further summarized in the following paragraphs and is further characterized by combinations of any and all of the various aspects, described herein.

According to one aspect of the present disclosure, a vacuum insulated appliance includes a cabinet with an outer wrapper and an inner liner coupled to the outer wrapper. A cabinet vacuum insulated cavity is defined between the outer wrapper and the inner liner. A trim breaker is coupled to the outer wrapper and the inner liner, and the trim breaker seals the cabinet vacuum insulated cavity. A wrapper evacuation port is defined by the outer wrapper. The wrapper evacuation port is in fluid communication with the cabinet vacuum insulated cavity for evacuating air from the cabinet vacuum insulated cavity. A first porous foam is coupled to an inner surface of the outer wrapper. The first porous foam defines a first plurality of pores. The first plurality of pores defines a first airflow path that is in fluid communication with the wrapper evacuation port. A door assembly is coupled to a front portion of the cabinet. The door assembly includes a door wrapper. A door liner is coupled to the door wrapper. A door vacuum insulated cavity is defined between the door wrapper and the door liner. A door evacuation port is defined by the door liner. The door evacuation port is in fluid communication with the door vacuum insulated cavity for evacuating air from the door vacuum insulated cavity. A second porous foam is coupled to an inner surface of the door liner. The second porous foam defines a second plurality of pores. The second plurality of pores defines a second airflow path in fluid communication with the door evacuation port.

According to another aspect, an insulation powder is disposed within a cabinet vacuum insulated cavity and a door vacuum insulated cavity of a door assembly.

According to another aspect, an insulation powder includes insulation particles, and each insulation particle of the insulation powder has a width greater than a width of each pore of a first plurality of pores and a second plurality of pores.

According to another aspect, a first porous foam and a second porous foam are an open-cell spray foam.

According to another aspect, a first porous foam is disposed along an entirety of the inner surface of an outer wrapper.

According to another aspect, a first porous foam is disposed along a rear panel of an outer wrapper.

According to another aspect of the present disclosure, a vacuum insulated appliance includes a cabinet with an outer wrapper and an inner liner coupled to the outer wrapper. A cabinet vacuum insulated cavity is defined between the outer wrapper and the inner liner. A trim breaker is coupled to the outer wrapper and the inner liner, and the trim breaker seals the cabinet vacuum insulated cavity. A wrapper evacuation port is defined by the outer wrapper. The wrapper evacuation port is in fluid communication with the cabinet vacuum insulated cavity for evacuating air from the cabinet vacuum insulated cavity. A porous foam is coupled to and extends along an inner surface of the outer wrapper. The porous foam defines a plurality of pores. The plurality of pores defines at least one first airflow path in fluid communication with the wrapper evacuation port for evacuating air from the cabinet vacuum insulated cavity through the at least one first airflow path.

According to another aspect, a porous foam is an open-cell foam, and the open-cell foam is bonded to an inner surface of an outer wrapper.

According to another aspect, an insulation powder includes insulation particles, and each insulation particle of the insulation powder has a width greater than a width of each pore of a plurality of pores.

According to another aspect, at least one first airflow path includes a plurality of first airflow paths each in fluid communication with the wrapper evacuation port.

According to another aspect, a door assembly is coupled to a front portion of an outer wrapper. The door assembly includes a structural wrapper defining a door vacuum insulated cavity. The structural wrapper defines a door evacuation port in fluid communication with the door vacuum insulated cavity. Insulation powder is disposed within the door vacuum insulated cavity, and a second porous foam is coupled to an inner surface of the structural wrapper. The second porous foam defines a second plurality of pres. The second plurality of pores defines a second airflow path in fluid communication with the door evacuation port for evacuating air from the door vacuum insulated cavity, through the second airflow path, and through the door evacuation port.

A door wrapper and a door liner coupled to the door wrapper. A door vacuum insulated cavity is defined between the door wrapper and the door liner. A door evacuation port is defined by the door liner. Insulation powder is disposed within the door vacuum insulated cavity. A second porous foam is coupled to an inner surface of the door liner. The second porous foam defines a second plurality of pores. The second plurality of pores defines a second airflow path in fluid communication with the door evacuation port for evacuating air from the door vacuum insulated cavity, through the second airflow path, and through the door evacuation port.

According to another aspect, a porous foam is a spray foam bonded to an inner surface.

According to another aspect, a porous foam is disposed along an inner periphery of a rear panel of an outer wrapper.

According to another aspect of the present disclosure, a vacuum insulated door assembly for an appliance includes a door wrapper. A door liner is coupled to the door wrapper. The door liner defines a door evacuation port. A door vacuum insulated cavity is defined between the door wrapper and the door liner. Insulation powder is disposed within the door vacuum insulated cavity. A porous foam is coupled to an inner surface of the door liner. The porous foam defines a plurality of pores. The plurality of pores defines a plurality of airflow paths in fluid communication with the door vacuum insulated cavity and the door evacuation port for evacuating air from the door vacuum insulated cavity, through the plurality of airflow paths, and the door evacuation port.

According to another aspect, a plurality of airflow paths directs an airflow toward a door evacuation port, and the airflow at least partially flows in a direction parallel to an inner surface of a door liner.

According to another aspect, an insulation powder includes insulation particles, and each pore of a plurality of pores has a width less than a width of each particle of the insulation powder.

According to another aspect, a door assembly is coupled to a cabinet. The cabinet includes an outer wrapper. An inner liner is coupled to the outer wrapper. A cabinet vacuum insulated cavity is defined between the outer wrapper and the inner liner. A wrapper evacuation port is defined by the outer wrapper. The wrapper evacuation port is in fluid communication with the cabinet vacuum insulated cavity for evacuating air from the cabinet vacuum insulated cavity. A second porous foam is coupled to and extending along an inner surface of the outer wrapper. The second porous foam defines a second plurality of pores. The second plurality of pores defines a second plurality of airflow paths in fluid communication with the wrapper evacuation port for evacuating the air from the cabinet vacuum insulated cavity through the second plurality of airflow paths.

According to another aspect, a porous foam is disposed along an entirety of an inner surface of a door liner.

According to another aspect, a thickness of a door wrapper is greater than a thickness of a porous foam.

According to another aspect, a porous foam is an open-cell spray foam bonded to an inner surface of a door liner.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes, and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A vacuum insulated appliance, comprising:

a cabinet including:

an outer wrapper having a top panel, a rear panel, and a bottom panel;

an inner liner coupled to the outer wrapper, wherein a cabinet vacuum insulated cavity is defined between the outer wrapper and the inner liner;

a trim breaker coupled to the outer wrapper and the inner liner, the trim breaker sealing the cabinet vacuum insulated cavity;

a wrapper evacuation port defined by the outer wrapper, wherein the wrapper evacuation port is in fluid communication with the cabinet vacuum insulated cavity for evacuating air from the cabinet vacuum insulated cavity; and a first porous foam coupled to an inner surface of the outer wrapper, the first porous foam defining a first plurality of pores, wherein the first plurality of pores define a first airflow path in fluid communication with the wrapper evacuation port, wherein the first porous foam forms a continuous layer spanning the top, rear, and bottom panels of the outer wrapper, the continuous layer being spaced from the inner liner and lining at least two corners of the cabinet; and a door assembly coupled to a front portion of the cabinet, the door assembly including:

a door wrapper;

a door liner coupled to the door wrapper, wherein a door vacuum insulated cavity is defined between the door wrapper and the door liner, and wherein the door liner includes a peripheral wall;

a door evacuation port defined by the door liner, wherein the door evacuation port is in fluid communication with the door vacuum insulated cavity for evacuating air from the door vacuum insulated cavity; and a second porous foam coupled to and spanning an inner surface of the door liner, the second porous foam defining a second plurality of pores, wherein the second plurality of pores defines a second airflow path in fluid communication with the door evacuation port, and wherein the second porous foam defines a ridge layer extending between the door wrapper and the inner surface of the door liner along the peripheral wall.

2. The vacuum insulated appliance of claim 1, further comprising:

an insulation powder disposed within each of the cabinet vacuum insulated cavity and the door vacuum insulated cavity.

3. The vacuum insulated appliance of claim 2, wherein the insulation powder includes insulation particles, and wherein each insulation particle of the insulation powder has a width greater than a width of each pore of the first plurality of pores and the second plurality of pores.

4. The vacuum insulated appliance of claim 1, wherein the first porous foam and the second porous foam are an open-cell spray foam having a plurality of cells, wherein the plurality of cells in a central region of at least one of the top, rear, and bottom panels of the cabinet and the door assembly includes a greater number of pores per cell than end regions thereof, and wherein each of the first and second porous foams has a thickness configured to be reduced in response to an evacuation of the air from the cabinet vacuum insulated cavity and the door vacuum insulated cavity, respectively.

5. The vacuum insulated appliance of claim 1, wherein the first airflow path includes a plurality of path portions that extend along an entirety of the inner surface of the outer wrapper.

6. The vacuum insulated appliance of claim 1, wherein the first porous foam is disposed along the rear panel of the outer wrapper, the rear panel defining an indent along which the first porous foam extends.

7. A vacuum insulated structure for an appliance, comprising:

an outer wrapper including a top panel, a rear panel, and a bottom panel, the rear panel defining a sloped indent;

an inner liner coupled to the outer wrapper, wherein a cabinet vacuum insulated cavity is defined between the outer wrapper and the inner liner;

a trim breaker coupled to the outer wrapper and the inner liner, the trim breaker sealing the cabinet vacuum insulated cavity;

a wrapper evacuation port defined by the outer wrapper, wherein the wrapper evacuation port is in fluid communication with the cabinet vacuum insulated cavity for evacuating air from the cabinet vacuum insulated cavity; and a porous foam coupled to and extending along an inner surface of the outer wrapper, the porous foam defining a plurality of pores, wherein the plurality of pores define a plurality of first airflow paths in fluid communication with the wrapper evacuation port for evacuating the air from the cabinet vacuum insulated cavity through the plurality of first airflow paths, wherein the porous foam forms a continuous layer spanning the top, rear, and bottom panels of the outer wrapper including along the sloped indent, the continuous layer lining at least two corners of the outer wrapper, and wherein the plurality of first airflow paths spans across the top, rear, and bottom panels.

8. The vacuum insulated structure of claim 7, wherein the porous foam is an open-cell foam, wherein the open-cell foam is bonded to the inner surface of the outer wrapper, and wherein the plurality of first airflow paths of the porous foam uniformly spans across the top, rear, and bottom panels.

9. The vacuum insulated structure of claim 7, further comprising:

an insulation powder disposed within the cabinet vacuum insulated cavity, wherein the insulation powder includes insulation particles, and wherein each particle of the insulation powder has a width greater than a width of each pore of the plurality of pores.

10. The vacuum insulated structure of claim 7, further comprising:

a door assembly coupled to a front portion of the outer wrapper, the door assembly including:

a structural wrapper defining a door vacuum insulated cavity, wherein the structural wrapper defines a door evacuation port in fluid communication with the door vacuum insulated cavity;

insulation powder disposed within the door vacuum insulated cavity; and a second porous foam coupled to an inner surface of the structural wrapper, the second porous foam defining a second plurality of pores, wherein the second plurality of pores define a second airflow path in fluid communication with the door evacuation port for evacuating air from the door vacuum insulated cavity, through the second airflow path, and through the door evacuation port.

11. The vacuum insulated structure of claim 7, wherein the porous foam is a spray foam bonded to the inner surface.

12. The vacuum insulated structure of claim 7, wherein the porous foam is disposed along an entirety of the inner surface of the rear panel of the outer wrapper.

13. The vacuum insulated structure of claim 7, wherein the porous foam spans the rear panel of the outer wrapper, and wherein the rear panel and the porous foam spanning the rear panel proximate the bottom panel are horizontally offset from the rear panel and the porous foam spanning the rear panel proximate the top panel.

* * * * *